US012662940B2

(12) United States Patent
Kristek et al.

(10) Patent No.: US 12,662,940 B2
(45) Date of Patent: Jun. 23, 2026

(54) SHAFT EXCAVATOR

(71) Applicant: REDPATH DEILMANN GMBH, Dortmund (DE)

(72) Inventors: Frank Kristek, Herdecke (DE); Patrick Jakob, Lümen (DE); Uwe Rüping, Kamen (DE)

(73) Assignee: REDPATH DEILMANN GMBH, Dortmund (DE)

( * ) Notice: Subject to any disclaimer, the term of this patent is extended or adjusted under 35 U.S.C. 154(b) by 6 days.

(21) Appl. No.: 18/687,131

(22) PCT Filed: Jul. 21, 2022

(86) PCT No.: PCT/DE2022/100532
§ 371 (c)(1),
(2) Date: Feb. 27, 2024

(87) PCT Pub. No.: WO2023/025341
PCT Pub. Date: Mar. 2, 2023

(65) Prior Publication Data

US 2024/0368989 A1 Nov. 7, 2024

(30) Foreign Application Priority Data

Aug. 27, 2021 (DE) ..... 10 2021 122 241.9

(51) Int. Cl.
*E21D 1/03* (2006.01)
*E21D 5/00* (2006.01)

(52) U.S. Cl.
CPC ..... *E21D 1/03* (2013.01); *E21D 5/00* (2013.01)

(58) Field of Classification Search
CPC ..... E21D 1/03; E21D 1/04; E21D 5/00
USPC ..... 405/133
See application file for complete search history.

(56) References Cited

U.S. PATENT DOCUMENTS 2,606,679 A * 8/1952 Cryderman ..... E21D 1/04 414/625
2,781,140 A * 2/1957 Cryderman ..... E02F 3/286 414/625
4,701,073 A * 10/1987 Sainsbury ..... E21D 1/00 405/133

FOREIGN PATENT DOCUMENTS

| | | | | |
|---|---|---|---|---|
| CN | 107130963 A * | 9/2017 | ..... | E21D 1/04 |
| CN | 114000884 A * | 2/2022 | ..... | E21D 7/00 |
| CN | 114320306 A * | 4/2022 | ..... | E21D 1/04 |
| ES | 2265739 | 2/2007 | | |
| ES | 2265739 A1 | 2/2007 | | |
| FR | 2603941 A1 * | 3/1988 | ..... | E21D 1/04 |
| JP | 2000-008763 A | 1/2000 | | |
| JP | 2005-336915 A | 12/2005 | | |

(Continued)

OTHER PUBLICATIONS

English translation of International Preliminary Report on Patentability for PCT Patent App. No. PCT/DE2022/100532 (Nov. 14, 2023).

(Continued)

*Primary Examiner* — Frederick L Lagman
(74) *Attorney, Agent, or Firm* — Cermak & McGowan LLP; Malcolm K. McGowan

(57) ABSTRACT

A working stage 1 is used for the installation of fixtures in vertical shafts in mining and tunnelling, which is suspended from one or more ropes and having at least one working level 2, 3, 4. A height-adjustable shaft excavator 5 is provided underneath working stage 1 for unloading and/or removing blasted debris.

12 Claims, 6 Drawing Sheets

(56) References Cited

FOREIGN PATENT DOCUMENTS

| | | | |
|---|---|---|---|
| JP | 2007-113340 | A | 5/2007 |
| RU | 2592580 | C1 | 7/2016 |
| WO | WO2014/078878 | A1 | 5/2014 |

OTHER PUBLICATIONS

International Search Report and Written Opinion for PCT Patent App. No. PCT/DE2022/100532 (Nov. 15, 2022) with English translation of ISR.
European Examination Report for European Patent App. No. 22757482.9 (Dec. 2, 2025).

* cited by examiner

SHAFT EXCAVATOR

CROSS-REFERENCE TO RELATED APPLICATIONS

This application is a national stage under 35 USC 371 of PCT/DE2022/100532, filed 21 Jul. 2022, which claims priority from German application 10 2021 122 241.9, filed 27 Aug. 2021. The contents of these priority applications are incorporated herein by reference in their entirety.

BACKGROUND

The invention relates to a working stage for sinking a shaft and for installing fixtures in vertical shafts in mining and tunnelling, being suspended from one or more ropes and having at least one working platform.

A basic distinction is made between two different methods for sinking surface shafts in the solid, mechanical, and conventional sinking by drilling and blasting. Which method is suitable depends greatly on the circumstances on site and the different operating conditions in terms of geology, shaft diameter, depth, etc., especially since both methods have advantages and disadvantages. Shaft construction by means of drilling and blasting, for example, is characterised by advantages in the introduction of supports and a high degree of flexibility in adapting to rock characteristics, but must remain competitive in terms of increasing tunnelling output, especially in mechanical sinking. The process consists of drilling and blasting the bottom of the shaft, loading and conveying the blasted broken material via buckets and finally creating the shaft lining from the working platform in the shaft. From the middle of the 20th century to the present day, cactus grabs have been used for loading work on the bottom. Such a system is fixed under the working platform and is operated from the bottom by two people. Of these, one is responsible for opening and closing, and the other for positioning the gripper on the bottom of the shaft. Because the grapple can only penetrate the broken material by its own gravity, it is sometimes "dropped" by the second man with momentum, which can lead to dangerous situations on the bottom, especially since there are hardly any experienced operators for such systems nowadays.

SUMMARY

Thus, the present invention has the task of creating a working stage for the installation of fixtures in vertical shafts in mining and tunnel construction, which is characterised by an improvement in the sinking capacities to be achieved and in occupational safety with a reduction of the required manpower in the hazardous area.

This task is solved by at least one shaft excavator positioned below the working stage and adjustable in height, which is used to unload and/or remove blasted broken material.

This excavator can take over a variety of activities on the bottom of the shaft as well as at the shaft joint. This also applies to manual work at the shaft joint. This includes, for example, the unloading and/or removal of blasted broken material, the drilling of anchors and blast hole drilling, the connection of a suction excavator to clean the floor or other attachments for reworking the shaft bottom and the joint.

In addition to increased loading performance, this new concept also enables parallelization of work in the shaft, thus significantly increasing not only the sinking capacity, but also occupational safety. While the shaft lining is being brought in on the working stage, the blasted floor (the debris) is remotely controlled via the shaft excavator or automatically loaded into buckets and extracted. Thanks to the parallelisation of the normally sequential work, several hours can be saved on an entire work cycle. This significantly increases the sinking performance.

The fact that a device assigned to the working stage is used to adjust the height of the shaft excavator is to be understood as meaning that the respective shaft excavator is moved indirectly by means of a suitable device. The shaft excavator is therefore moved and positioned depending on the movement and/or swivelling of this unit. Such a device is understood, for example, as a telescopic pipe or a suspended adjustable platform of the working stage.

According to a first embodiment of the invention, it is therefore envisaged that a telescopic pipe is guided in the longitudinal axis of the working stage, at the lower end of which a shaft excavator is arranged. Thanks to the telescopic central pipe, the height of the shaft excavator assembly can be adjusted (as well). The advantage of this solution is the possibility of precise movement of the excavator without the need to move the working stage. In addition, maintenance on the excavator arm is much easier thanks to hinged platforms on the shaft excavator. The hinged platforms can be used to work on the unsecured shaft wall, for example to install support rings or as part of other safety measures. The power supply is protected by the central pipe and the hydraulic units can be stored outside the working areas.

The second embodiment of the invention is that the shaft excavator is located on the underside of the lowest working platform. For this purpose, an additional lowest working platform can also be suspended below the working stage. For example, if there are three working platforms, the working stage is supplemented by a fourth, lower one. Such a platform, also known as a suspended excavator platform, also has significant advantages. These include the accessibility of the hydraulic and electrical supply lines, the transmission of vibrations from the shaft excavator to the working stage, the necessary anti-rotation device for the central pipe or a high level of effort with regard to the interchangeability of hydraulic hoses in the telescopic pipe.

The telescopic central pipe or the lowest working platform forms the bearing for the shaft excavators used for unloading and/or transporting the blasted broken material, together with the necessary units for this assembly. In this sense, it is understood that a console should be provided at the bottom of the telescopic pipe or on the underside of the lowest working platform for connecting the shaft excavator. The console has a dual function if the console is used to move and/or swivel the shaft excavator, but it is also conceivable that it is only possible to move or swivel.

A preferred embodiment of the invention is that the shaft excavator is guided in a carriage in the console. The carriage thus enables the movement of the shaft excavator together with its units in the console.

It is also envisaged that a boom of the shaft excavator is to be guided in the carriage, having an upper and a lower part.

Further measures provide that a handle is hinged on the upper part of the boom and that the end of the handle facing away from the console is used to steer a tool, in particular a backhoe bucket.

A protective measure for cylinders, hoses, etc. gives the shaft excavator according to the invention additional robustness and also improves availability. For this purpose, cylinders and/or supply hoses are arranged within a protective housing surrounding the upper part of the boom. The inner tubing prevents tearing or damage to the hoses.

The shaft excavator can be operated from a working stage or from above ground. When the control unit is used, the filled backhoe bucket can be positioned automatically and emptied over the bucket anywhere in the area of the bottom of the shaft.

Furthermore, it is planned that a camera system will be assigned to the working stage, preferably a 3D camera system, in order to optimise these processes even more.

A preferred embodiment is that the stored position of a broken material kibble serves as a reference value for positioning and/or emptying the backhoe bucket. Once the position of the broken material kibble has been stored, the filled backhoe bucket can be automatically positioned and emptied exactly above the bucket from any point on the bottom of the shaft by pressing a button on the control unit. This is done with high precision and uniformity thanks to the alignment of the shaft excavator and its assembly with boom, stick, backhoe bucket, etc. The return to the last operating point is also automatic, so that the operator only has to fill the backhoe bucket with broken material. These computer-aided movement sequences and positioning can be carried out faster, more precisely and more safely than with any manual control, in particular in the tight space available in the shaft.

Such a loading cycle can be further optimised with regard to the work to be carried out on the bottom of the shaft by placing the shaft lining on the working stage and loading and conveying the blasted floor into buckets at the same time.

The invention also relates to a shaft excavator for a working stage according to at least one of the patent claims.

The invention is characterised in particular by the fact that a working stage is created for the installation of fixtures in vertical shafts in mining and tunnel construction, which contributes significantly to underground safety in the context of shaft sinking by carrying out the processes of unloading and conveying blasted broken material almost automatically. The deployment of personnel in this critical area is obsolete. In addition, it is possible to control the shaft excavator and its assembly precisely and ensure uniform unloading/discharging. To this end, two different solutions are proposed, namely a telescopic pipe that runs along the longitudinal axis of the working stage and at the lower end of which at least one shaft excavator is positioned. The alternative is a lower, possibly additional working platform for the working stage with appropriate suspension. There is a console on the telescopic pipe or on the lowest working platform in which the assembly is kept movable around the excavator, which can also be swivelled if necessary.

While the shaft lining is brought in on the working stage, the blasted floor is loaded into buckets and extracted via the shaft excavator without manual intervention. The shaft excavator can be operated from the working stage or from above ground. In addition, there is potential for optimisation with regard to the work to be carried out on the bottom of the shaft in that the loading cycle can be partially automated.

In addition to the pure loading activity, there are other possible applications for the shaft excavator that can significantly speed up the work process. This includes making the floor ready for drilling, i.e. removing the "last cm" of broken material before the solid rock by means of a suction unit attached to the quick coupler, the scaling of the shaft joint and using a powerful mounted cutting unit and a drill rig for inserting the blast hole holes is to be regarded as helpful.

BRIEF DESCRIPTION OF THE DRAWINGS

Further details and advantages of the subject-matter of the invention can be found in the following description of the corresponding drawing, in which a preferred embodiment with the necessary details and individual parts is shown. The following can be seen.

DETAILED DESCRIPTION

Figure 1:
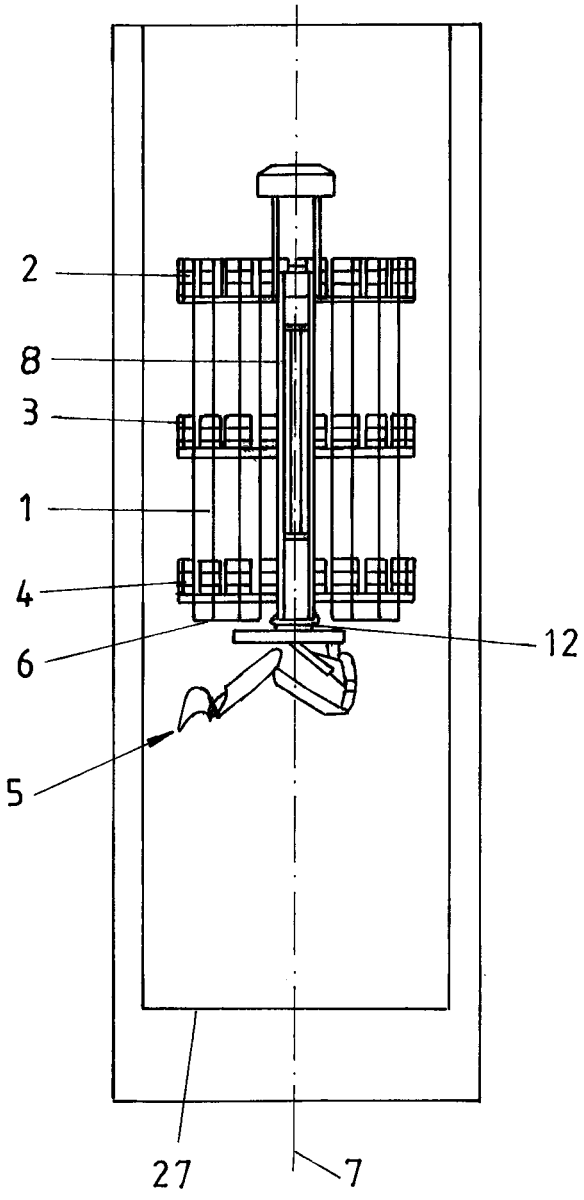
FIG. 1 shows a working stage with telescopic pipe in a retracted position.

FIG. 1 shows a working stage 1 for the installation of fixtures in vertical shafts in mining and tunnelling with three working platforms 2, 3 and 4. Working stage 1 has a pipe 8, 9 positioned in the longitudinal axis 7. The pipes are designed to be telescopic, with the inside pipe 9 retracted here, so that the height of the shaft excavator 5 can be adjusted by moving the inside pipe 9 in the direction of the longitudinal axis 7. In the illustration shown in FIG. 1, the shaft excavator 5 is located directly below working stage 1.

Figure 2:
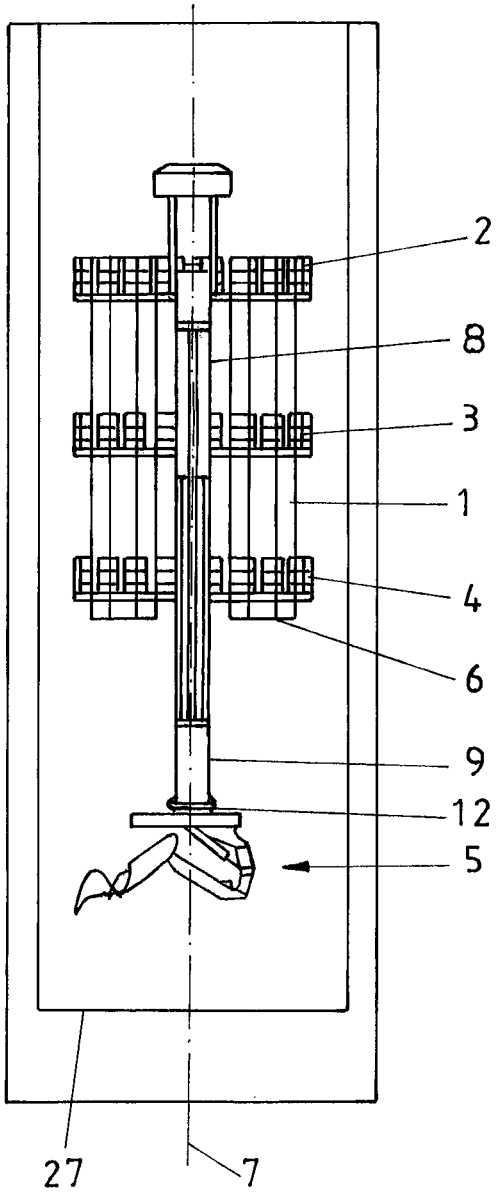
FIG. 2 shows a working stage with telescopic pipe in an extended position.

In comparison to this, in the illustration according to FIG. 2 the inside pipe 9 is shown in a downward extended position, so that the shaft excavator 5 can be used down to the bottom of the shaft 27. This consists of ensuring that the blasted broken material is unloaded and removed by means of buckets not shown here after drilling and blasting the bottom of the shaft 27.

Figure 3:
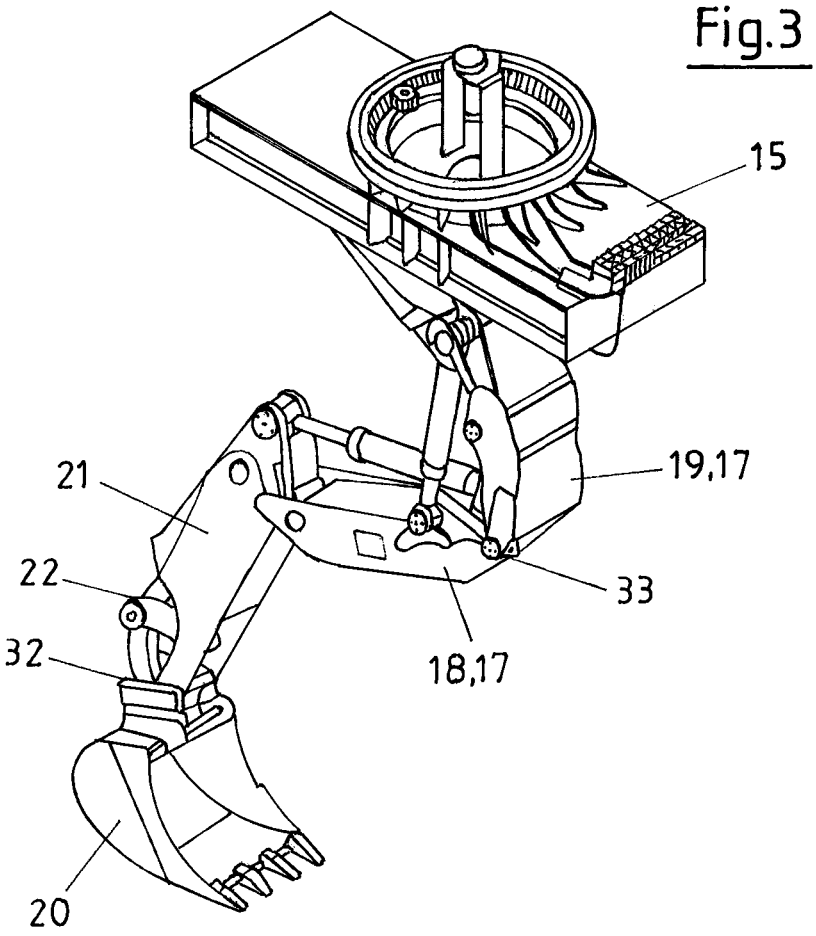
FIG. 3 shows a shaft excavator with console.

According to FIG. 3, console 15 is to be connected to inside pipe 9 or the underside 14 of the lowest working platform 13—neither of which is shown here. On this console 15, in turn, the carriage, which cannot be seen here, can be moved and thus ensures the movement of the shaft excavator 5 with the boom 17, consisting of an upper part 18 and a lower part 19. The latter are connected to each other via joint 33. The handle 21 is connected to the lower part 19, at the end of which the tool 22, to which the tool 20 in the form of a backhoe bucket, is attached on the end opposite the boom 17. A quick coupler 32 may be used to change this tool 20. Cylinders are marked with the reference marks 24, 25 or 33, 34.

Figure 4:
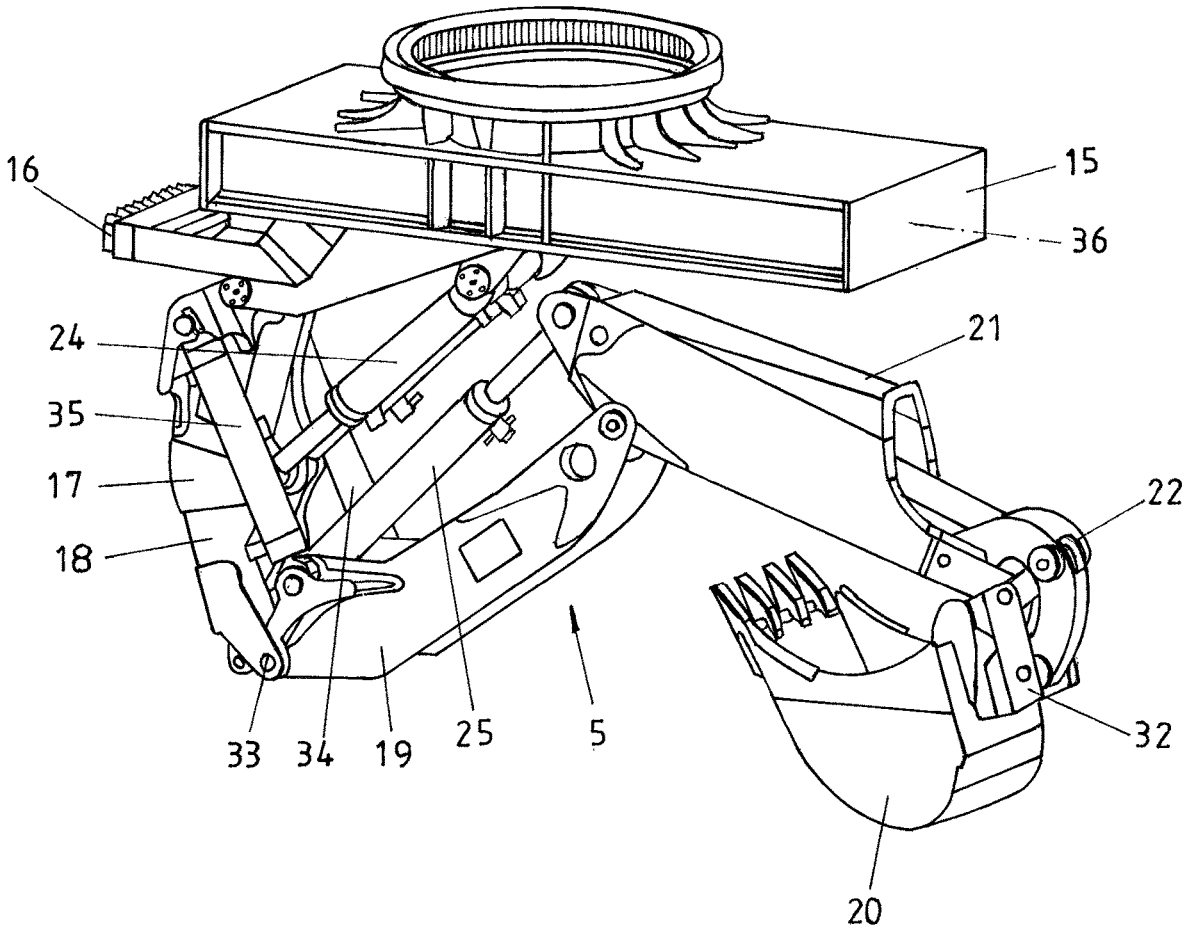
FIG. 4 shows a shaft excavator in a different position.

FIG. 4 in a different position shows otherwise the identical shaft excavator with the slide 16 that can be moved on or under console 15 in the direction of its longitudinal axis 36.

Figure 5:
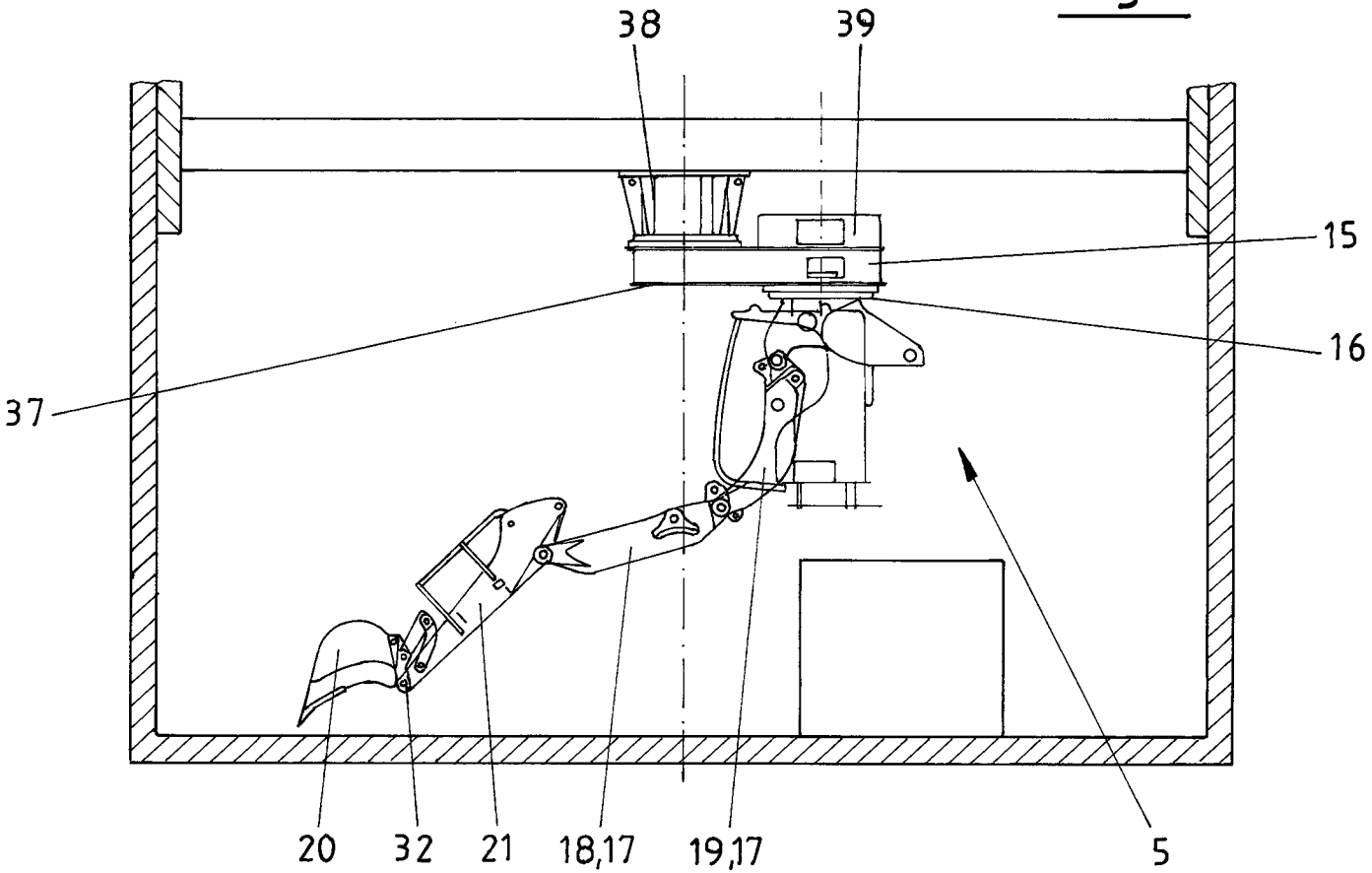
FIG. 5 shows a shaft excavator with swivel mechanism.

FIG. 5 shows the assembly for the shaft excavator 5 again with the console 15, on the underside 37 of which the shaft excavator 5 can be moved by means of slide 16. Two rotating and swivel devices 38 and 39 allow the shaft excavator 5 to be adjusted to almost any position.

Figure 6:
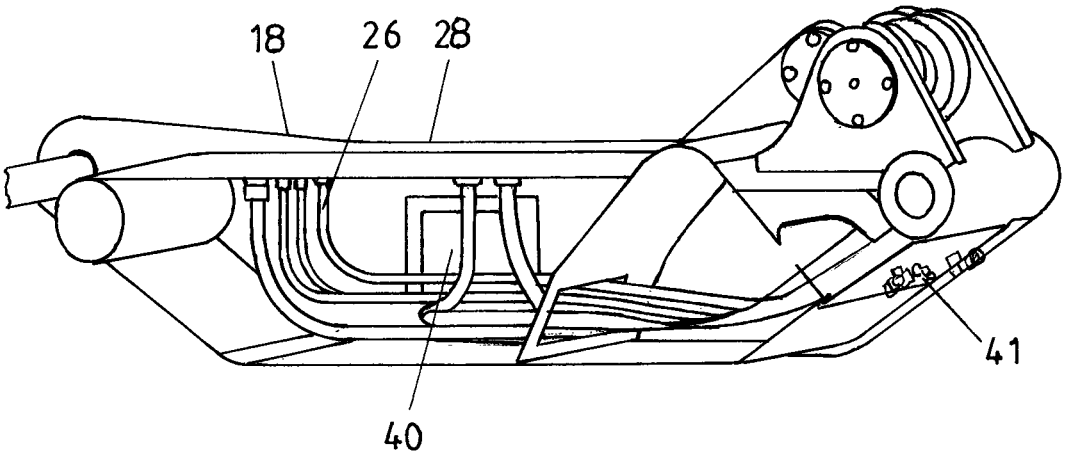
FIG. 6 shows the view into a boom.

A view into boom 18 is shown in FIG. 6 with a mounting opening 40 and in particular a view of the tubes, one of which is marked as 26 as an example, here the connection point for the handle. Cables 26 are therefore positioned in housing 28 of boom 17 and are therefore optimally protected.

Figure 7:
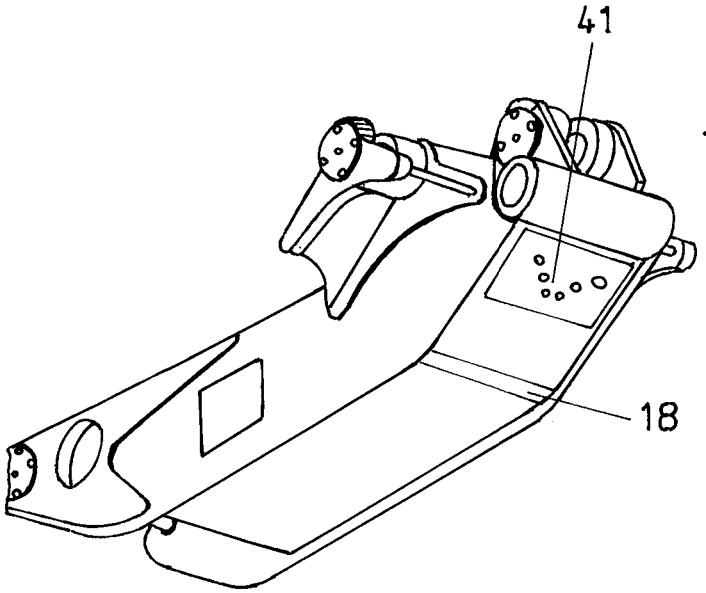
FIG. 7 shows a boom in perspective view.

Boom 17 is shown again in FIG. 7 with the bulkhead panel 41.

Figure 8:
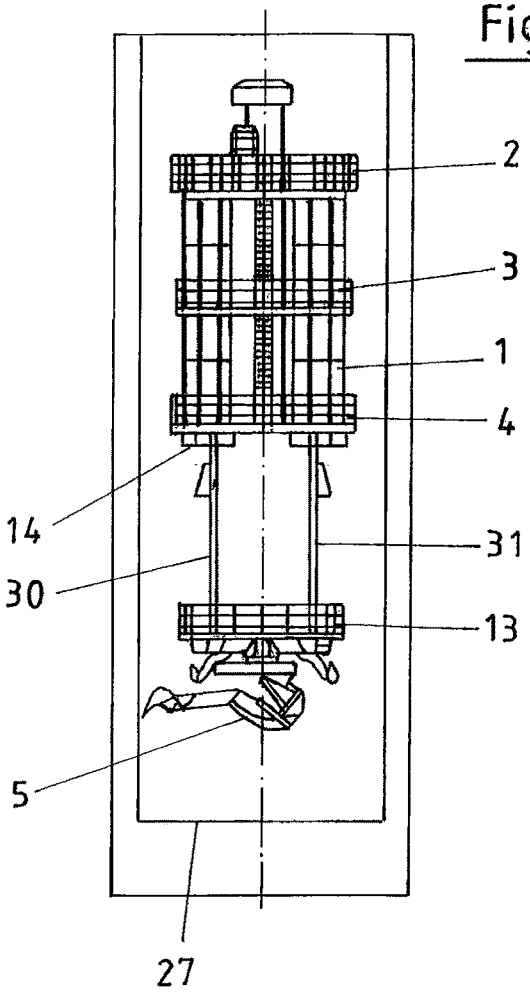
FIG. 8 shows a working stage with an additional working platform in front view and FIG. 9 shows a perspective view of a working platform shaft excavator.

The subject of FIG. 8 is the variant of the invention for a working stage 1 with an additional lowest working platform 13 below the working platforms 2, 3, 4. The additional working platform 13 is connected via ropes 30, 31 to the working stage 1 with its three working platforms 2, 3 and 4. At the bottom of the shaft 14 is the shaft excavator 5, which is already very close to the bottom of the shaft 27.

Figure 9:
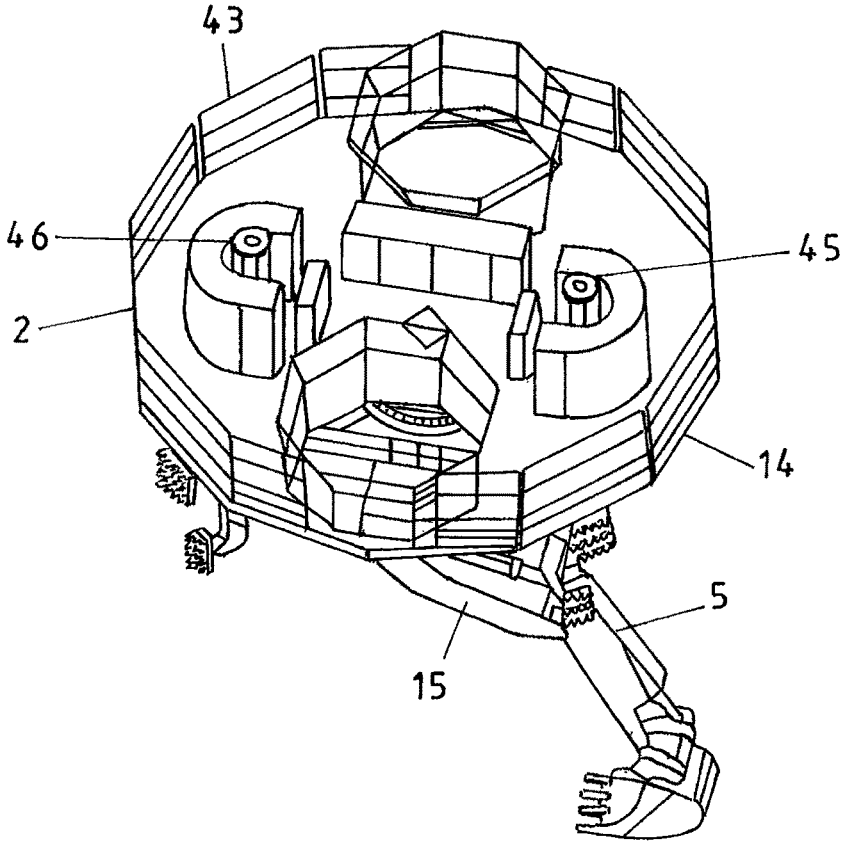

This is illustrated again in FIG. 9 with the shaft excavator 5 below the working stage 13 with its various installations such as a railing 43 and the connections 45, 46 for the ropes not shown here.

The invention claimed is:

1. Working stage (1) for sinking a shaft and for installing equipment in vertical shafts in mining and tunnelling, being suspended from one or more ropes and having at least one working platform (2, 3, 4), with at least one height adjustable shaft excavator (5) positioned below the working stage (1) and used for unloading and/or transporting blasted broken material, wherein the working stage (1) having a longitudinal axis (7) in which is disposed a telescopic pipe (8, 9) with an inside pipe (9) and an outer pipe (8) having a lower end at which (12) is arranged a shaft excavator (5) and that while a shaft lining is being inserted on the working stage, the blasted broken material is loaded remotely and/or automatically into a bucket and extracted via the shaft excavator without manual intervention;

wherein a console (15) for connecting the shaft excavator (5) is provided at the lower end (12) of the telescopic pipe (8, 9) or under a lowest working platform which is in a lower position in the shaft than any other working platform; wherein the console (15) is used to move and/or swivel the shaft excavator (5); and wherein the shaft excavator (5) is guided in a carriage (16) in the console (15).

2. Working stage according to claim 1, wherein the shaft excavator (5) has a height which is adjusted by a device (8, 9, 13) assigned to the working stage (1).

3. Working stage according to claim 1, wherein the shaft excavator (5) is located at a bottom (14) of the lowest working platform.

4. Working stage according to claim 1, wherein the insertion of the shaft lining on the working stage (1) and the loading and conveying of the blasted broken material in buckets take place simultaneously.

5. Working stage according to claim 1, wherein the operation of the shaft excavator (5) is carried out from the working stage (1) or from above ground.

6. Working stage according to claim 1, wherein a boom (17) of the shaft excavator (5) is guided in the carriage (16).

7. Working stage according to claim 6, wherein the boom (17) has an upper part (18) and a lower part (19).

8. Working stage according to claim 7, wherein a handle (21) is hinged on the upper part (18) of the boom (17).

9. Working stage according to claim 8, wherein an end (22) of the handle (19) facing away from the console (15) is used to steer a tool (20).

10. Working stage according to claim 6, wherein cylinders (24, 25) and/or supply hoses (26, 27) are arranged within the boom.

11. Working stage according to claim 1, wherein a camera system is assigned to the working stage (5).

12. Working stage according to claim 1, wherein a stored position of a recovery bucket serves as a reference value for positioning and/or emptying a backhoe bucket (20).

* * * * *